US008466442B2

(12) United States Patent
Horvath et al.

(10) Patent No.: US 8,466,442 B2
(45) Date of Patent: Jun. 18, 2013

(54) NAIL GEL CURING APPARATUS

(75) Inventors: Gavril Horvath, Tarzana, CA (US); George Schaeffer, North Hollywood, CA (US)

(73) Assignee: O P I Products, Inc., North Hollywood, CA (US)

( * ) Notice: Subject to any disclaimer, the term of this patent is extended or adjusted under 35 U.S.C. 154(b) by 67 days.

(21) Appl. No.: 13/188,349

(22) Filed: Jul. 21, 2011

(65) Prior Publication Data

US 2013/0020509 A1 Jan. 24, 2013

(51) Int. Cl.
*B01J 19/12* (2006.01)

(52) U.S. Cl.
USPC ..... 250/504 R; 132/73; 118/620; 34/275

(58) Field of Classification Search
USPC ..... 250/504 R; 132/73; 118/620; 34/275
See application file for complete search history.

(56) References Cited

U.S. PATENT DOCUMENTS 4,979,523 A * 12/1990 Grimm ..... 132/73.5
6,762,425 B1 * 7/2004 Strait ..... 250/504 R
7,804,074 B2 * 9/2010 Bernecker ..... 250/455.11
8,242,475 B1 * 8/2012 Cheng ..... 250/504 R
2010/0293805 A1 * 11/2010 Chang ..... 34/202
2011/0036997 A1 * 2/2011 Lai ..... 250/492.1
2011/0277338 A1 * 11/2011 Li et al. ..... 34/275
2012/0187311 A1 * 7/2012 Vu et al. ..... 250/492.1

* cited by examiner

*Primary Examiner* — Michael Logie
(74) *Attorney, Agent, or Firm* — Blakely, Sokoloff, Taylor & Zafman

(57) ABSTRACT

An apparatus to provide ultra-violet (UV) irradiation to cure a gel nail. The apparatus includes a top section and a bottom section, the top and bottom sections forming a unit with an opening sized to allow at least a portion of a human hand to be inserted. An array of light emitting diodes (LEDs) disposed in the unit to emit UV irradiation in a first direction when supplied with electrical power. At least one LED is disposed in the unit to emit UV irradiation in a second direction when supplied with electrical power. The first direction is approximately perpendicular to the second direction such that fingernails and a thumbnail of a human hand inserted into the opening substantially simultaneously receive amounts of UV irradiation sufficient to cure a UV curable gel applied to the fingernails and the thumbnail at approximately the same time.

17 Claims, 6 Drawing Sheets

NAIL GEL CURING APPARATUS

BACKGROUND OF THE INVENTION

Nail gel curing apparatus which operate by using a plurality of light emitting diodes (LEDs) operating at an ultra-violet (UV) wavelength suitable for curing gels of the type applied to fingernails for decorative purposes are well known. For example U.S. Patent Application Publication No. 2011/0036997 discloses ultraviolet equipment which utilize LEDs which generate a UV wavelength suitable for the curing of a gel applied to the fingernail of a user. By placing the fingers into the unit, the fingernails are irradiated with a UV light which results in the gel applied to the fingernails being cured.

However, as is typical in the prior art, the source of the UV radiation, whether LEDs or other source of UV radiation, is arranged so that the fingernails are irradiated from above. Although such prior art devices are suitable for curing gel on the fingernails of the four fingers of the hand, the thumbnail typically does not receive the same amount of direct UV illumination which results in the gel on the thumbnail not being adequately cured, or which requires the user to place the thumb into the unit either before or after the fingernails of the four fingers have been exposed to the UV irradiation for curing of the gel thereon.

The reason the thumbnail does not receive adequate irradiation is due to the anatomy of a typical hand in which when the four fingers are extended and the thumb is extended, the four fingernails lie in approximately the same plane and are spaced relatively closely to one another. However, the thumbnail is spaced apart from the other four fingernails, and lies in a plane which can be almost perpendicular to the plane of the four fingernails.

The following are the results of this hand repositioning:

1. Customer must change hand position, making a first with the thumb extended straight out, facing upwards. Incorrect positioning of thumbs results in potential service failure.
2. Curing thumbs separately doubles the amount of time the curing process takes, thus lengthening total service time.
3. Normal sequence of application is disrupted, also lengthening total service time, and creating opportunity for application mistakes.

As a result, the length of exposure to UV light doubles as compared to the invention as set forth in the following tables:

TABLE 1

Application & Curing with a prior art UV LED Light:

| Steps | Action | Cure Time |
|---|---|---|
| 1 | Apply Base Coat<br>Cure 4 Fingers (2-5) | 30 Seconds |
| 2 | Apply Color Coat<br>Cure 4 Fingers | 30 Seconds |
| 3 | Apply 2$^{nd}$ Color Coat<br>Cure 4 Fingers | 30 Seconds |
| 4 | Apply Top Coat<br>Cure 4 Fingers | 30 Seconds |
| 5 | Wipe Residue | |
| 6 | Apply Base Coat<br>Cure Thumb (finger 1) | 30 Seconds |
| 7 | Apply Color Coat<br>Cure Thumb | 30 Seconds |
| 8 | Apply 2$^{nd}$ Color Coat<br>Cure Thumb | 30 Seconds |
| 9 | Apply Top Coat<br>Cure Thumb | 30 Seconds |

TABLE 1-continued

Application & Curing with a prior art UV LED Light:

| Steps | Action | Cure Time |
|---|---|---|
| 10 | Wipe Residue | |
| 10 Steps | TOTAL CURE TIME (UV Light Exposure): | 4 Minutes Per Hand |

TABLE 2

Application & Curing using the invented UV LED Light:

| Steps | Action | Cure Time |
|---|---|---|
| 1 | Apply Base Coat<br>Cure Fingers 1-5 (including thumb) | 30 Seconds |
| 2 | Apply Color Coat<br>Cure Fingers 1-5 | 30 Seconds |
| 3 | Apply 2$^{nd}$ Color Coat<br>Cure Fingers 1-5 | 30 Seconds |
| 4 | Apply Top Coat<br>Cure Fingers 1-5 | 30 Seconds |
| 5 | Wipe Residue | |
| 5 Steps | TOTAL CURE TIME (UV Light Exposure): | 2 Minutes Per Hand |

The present invention overcomes the limitations of the prior art by including an additional UV light source which, for the thumbnail, is at the same relative position, i.e., angle and distance, as the UV source for the fingernails.

SUMMARY OF THE INVENTION

An apparatus for providing UV radiation for curing of gels on fingernails and thumbnails is disclosed. The apparatus includes an enclosure with a generally oval shaped opening into which a hand may be inserted. A board fits into a top section of the enclosure. The board includes LEDs arranged as an array so as to irradiate the fingernails of a person's hand when inserted into the opening. The LEDs are arranged so as to relatively uniformly irradiate the fingernails of a hand inserted into the opening. A base having a generally horseshoe shape fits into a bottom section of the enclosure. The horseshoe shaped base includes upright sections near the ends. The base and the board, when installed in the enclosure, are parallel to and aligned with each other.

Affixed to upright the sections are boards which each include one or more LEDs. As a result of being placed on the boards attached to the base which are approximately perpendicular to the board, UV light emanating from LEDs affixed to these two boards are approximately perpendicular to the UV irradiation emanating from LEDs affixed to the board located in the top section of the enclosure.

By virtue of the LEDs on the boards associated with base, and the LEDs on the board located in the top section of the enclosure, when a hand with a UV curable gel on the nails is inserted into the enclosure, the gel on the fingernails and the thumb nail are cured at the same time and at the same rate.

DETAILED DESCRIPTION OF THE INVENTION

Figure 1:
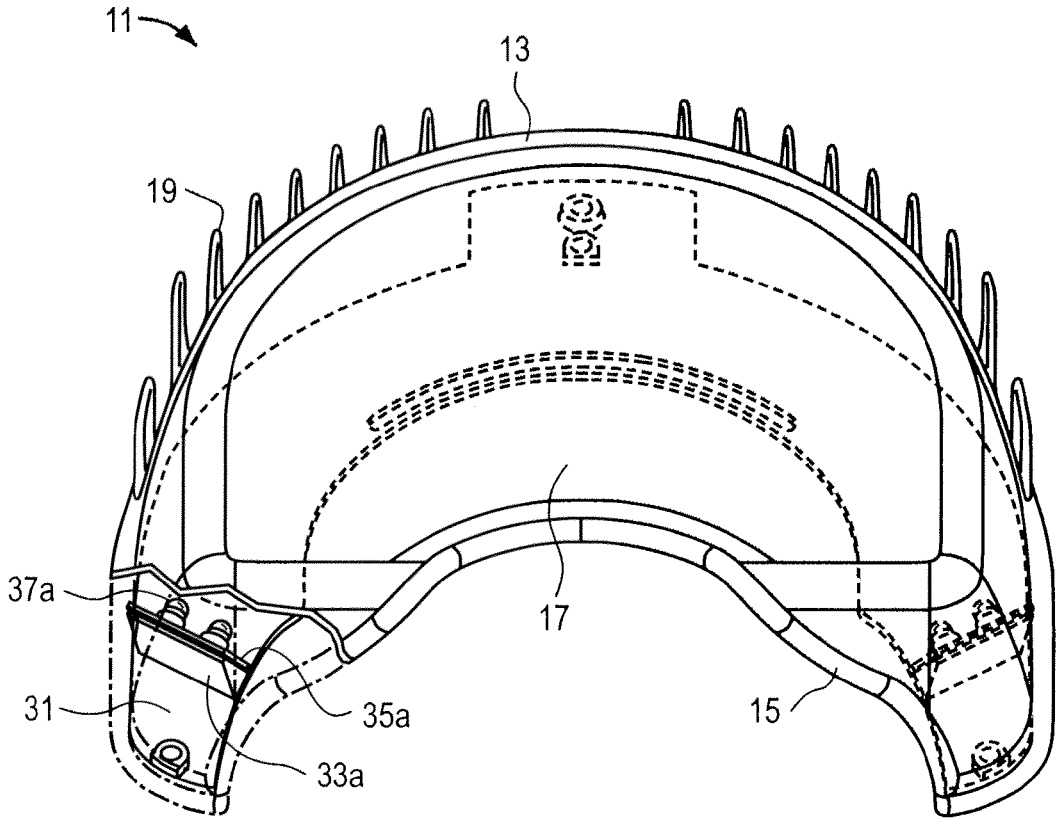
FIG. 1 is a top perspective view of the invented nail gel curing apparatus showing an internal base in shadow line with a cutaway portion showing part of the base.

Referring first to FIG. 1, an apparatus for providing UV radiation for curing of gels on fingernails and thumbnails is shown. The apparatus includes an enclosure 11 having a top section 13 and a bottom section 15 which fit together to provide a generally oval shaped opening 17 into which a hand may be inserted. Also shown in FIG. 1, in partial cutaway is a portion of base 31 which is inside the enclosure and attached to bottom section 15. Further details regarding base 21 are provided with reference to FIGS. 3*a* and 3*b* below. In one embodiment, the enclosure 11 includes fins 19 on the top section 13. The fins provide additional surface area so that any heat which is generated when the LEDs are powered on is dissipated quickly.

Figure 2:
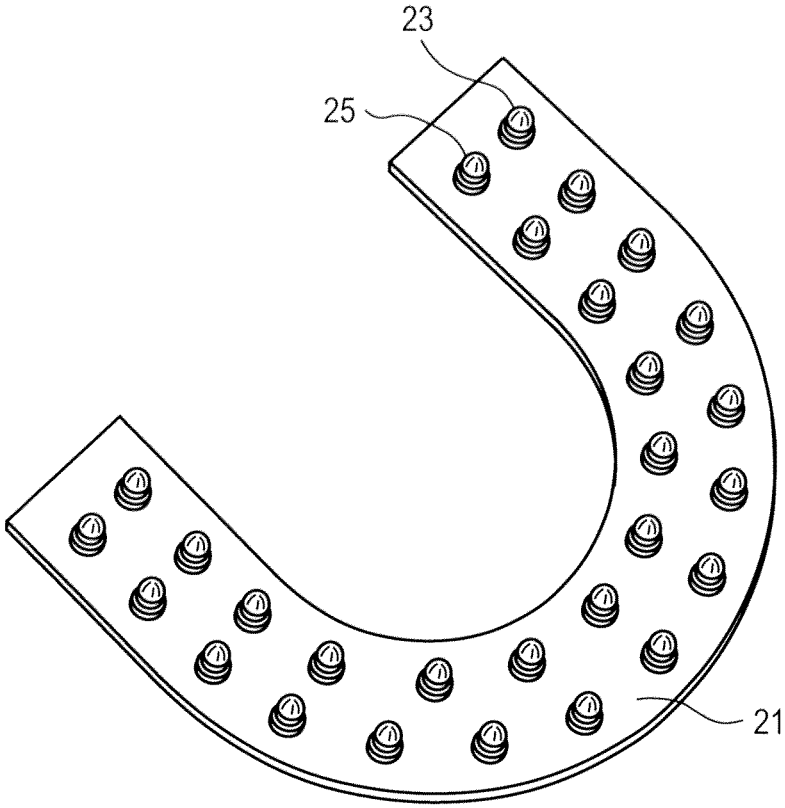
FIG. 2 is perspective view of a board with mounted which, in operation, is installed inside the apparatus shown in FIG. 1.

FIG. 2 is a detailed view of board 21 which fits into top section 13 of enclosure 11 (not shown in FIG. 2) of FIG. 1. Board 21 has a generally horseshoe shape. As shown in FIG. 2, board 21 includes LEDs arranged as an array so as to irradiate the fingernails of a person's hand when inserted into the opening 17 of FIG. 1. As shown in FIG. 2, board 21 includes two rows of LEDs 23 and 25. The LEDs in each row are typically electrically connected to each other in series with two rows electrically connected to each other in parallel. However, the specifics of these connections, and how the LEDs are arranged on the board, and whether a single board or multiple boards are utilized is not an important aspect of the invention. The only requirement is that the LEDs be arranged so as to relatively uniformly irradiate the fingernails of a hand inserted opening 17 shown in FIG. 1. Although not shown in FIG. 1, board 21 located inside enclosure 11 is attached to top section 13 with the LEDs facing down.

Figure 3A:
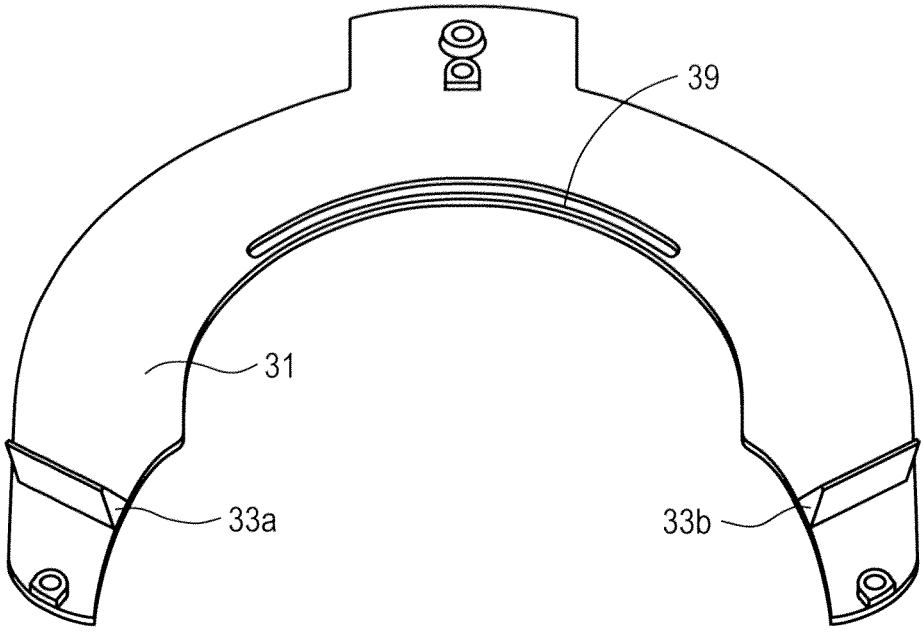
FIG. 3*a* is a top perspective view of the base.

Referring next to FIG. 3*a*, FIG. 3*a* shows a base 31 having a generally horseshoe shape affixed to bottom section 15 (not shown in FIG. 3*a*). Base 31 includes upright sections 33*a* and 33*b*. Base 31 and board 21, when installed in enclosure 11, are parallel to and aligned with each other as explained with reference to FIG. 4.

Figure 3B:
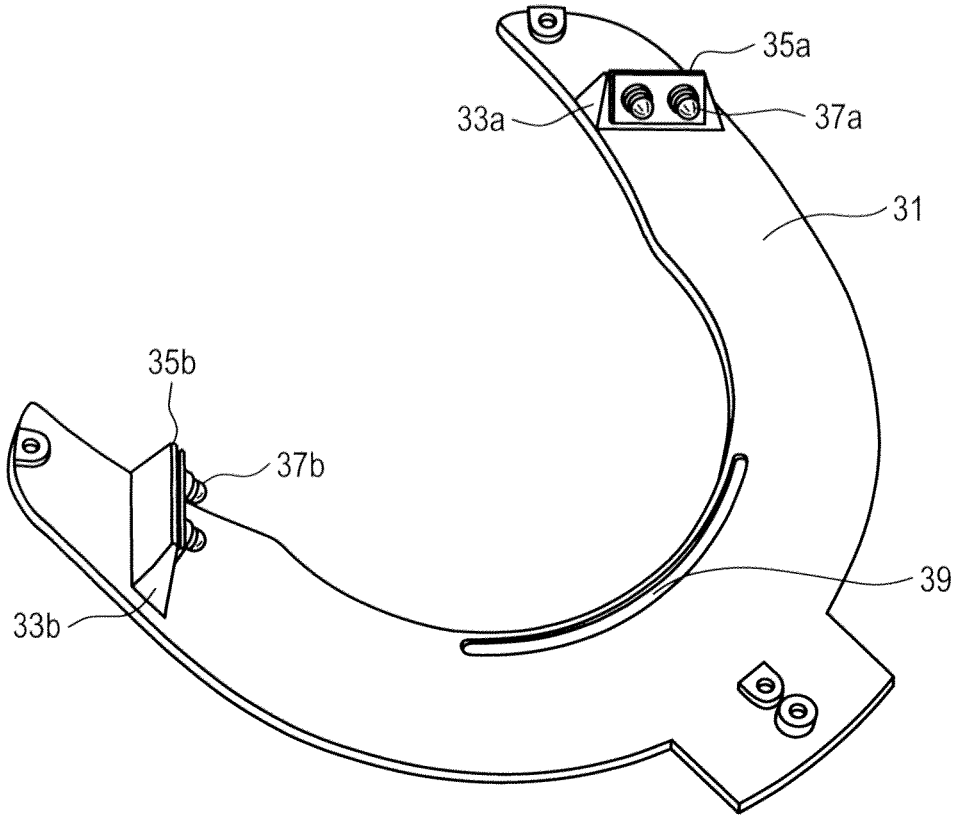
FIG. 3*b* is a side perspective view of the base with installed LEDs.

Referring next to FIG. 3*b*, affixed to upright sections 33*a* and 33*b* are boards 35*a* and 35*b* respectively. Each of the boards 35*a* and 35*b* includes one or more LEDs 37*a* and 37*b*. As a result of being placed on boards 35*a* and 35*b* approximately perpendicular to board 21 respectively, UV light emanating from LEDs 37*a* and 37*b* is directed approximately perpendicular to the UV irradiation emanating from LED rows 23 and 25.

In order to ensure proper positioning of the hand inserted into opening 17, base 31 also includes a touch sensitive sensor 39 near the middle of base 31. The sensor 39 is used as a guide so that the hand is properly oriented in the opening to ensure substantially even irradiation of the four fingernails and the thumbnail. When the fingers are positioned on the sensor, a switch in the sensor is closed which provides power supplied to the LEDs. Suitable sensors for this purpose are commercially available from a number of sources.

Figure 4:
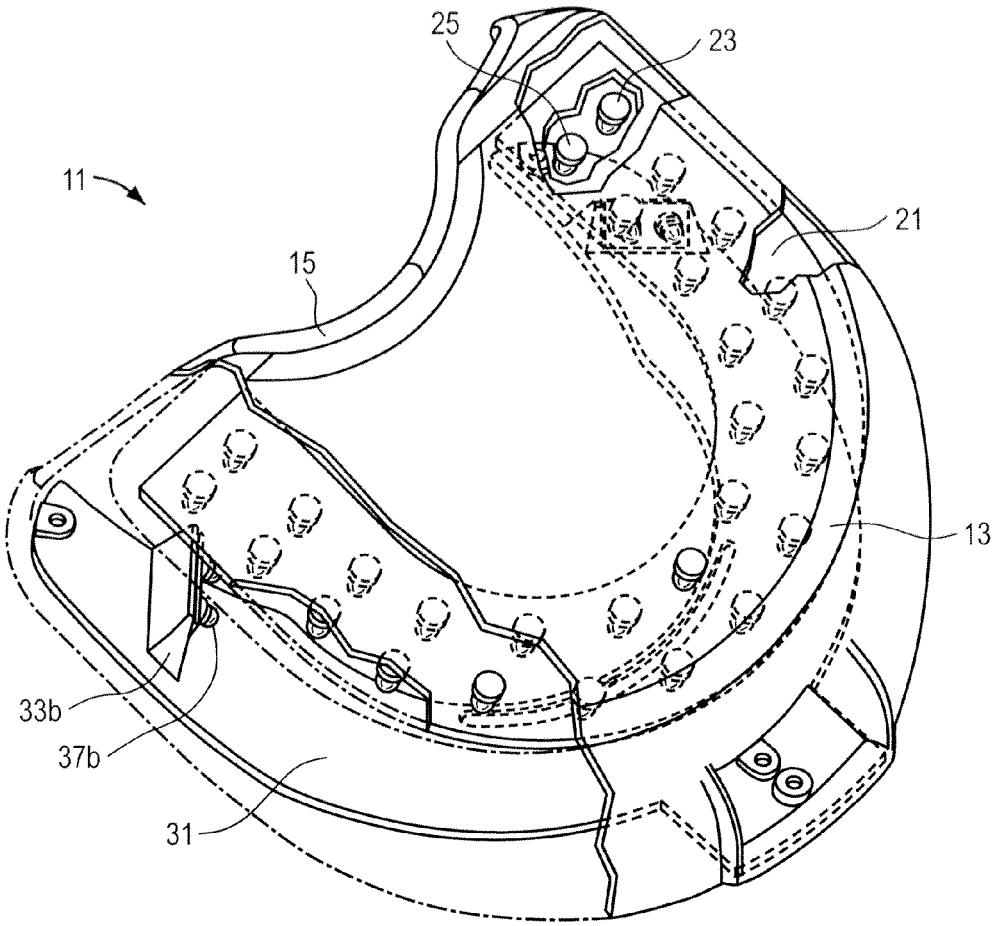
FIG. 4 is a side perspective view of the invented nail gel curing apparatus with cutaway portions showing the base and the board described in FIGS. 2, 3*a* and 3*b*.

FIG. 4 shows enclosure 11 with partial cutaways so as to show the relative position of base 31 and board 21. As illustrated, base 31 is affixed to base 15 of enclosure 11, and board 21 is affixed to top section 13 of enclosure 11. The specifics of the mechanism which is used to attach base 31 and board 21 are not important to an understanding of the invention. The only requirement is that board 21 should be parallel to base 31, and the base and board should be aligned to each other, and spaced apart so that when a hand is inserted into opening 17 (best seen in FIG. 1), UV light emanating from the LEDs on board 21, and the LEDs on boards 35*a* and 35*b* (best seen in FIG. 3*b*), irradiate the fingernails, and the thumbnail of the inserted hand at approximately the same level of intensity and angle of illumination. Although not shown, preferred embodiment, the LEDs on boards 35*a* and 35*b* are electrically connected to each other and to the LEDs on board 21 so that when power is applied to the LEDs, all of the LEDs on hoard 21, and the LEDs on boards 35*a* and 35*b* are powered at the same time and irradiate the fingernails and the thumbnail of the inserted hand with approximately the same intensity of UV light.

When a person's hand is inserted into opening 17, UV light emanating from the LEDs on board 21 irradiate the four fingernails, and UV light emanating from LEDs 37*a* irradiates the thumbnail on the right hand. In a similar manner, when a person's left hand is inserted into opening 17, LEDs 37*h* irradiate the thumbnail of the left hand.

Figure 5:
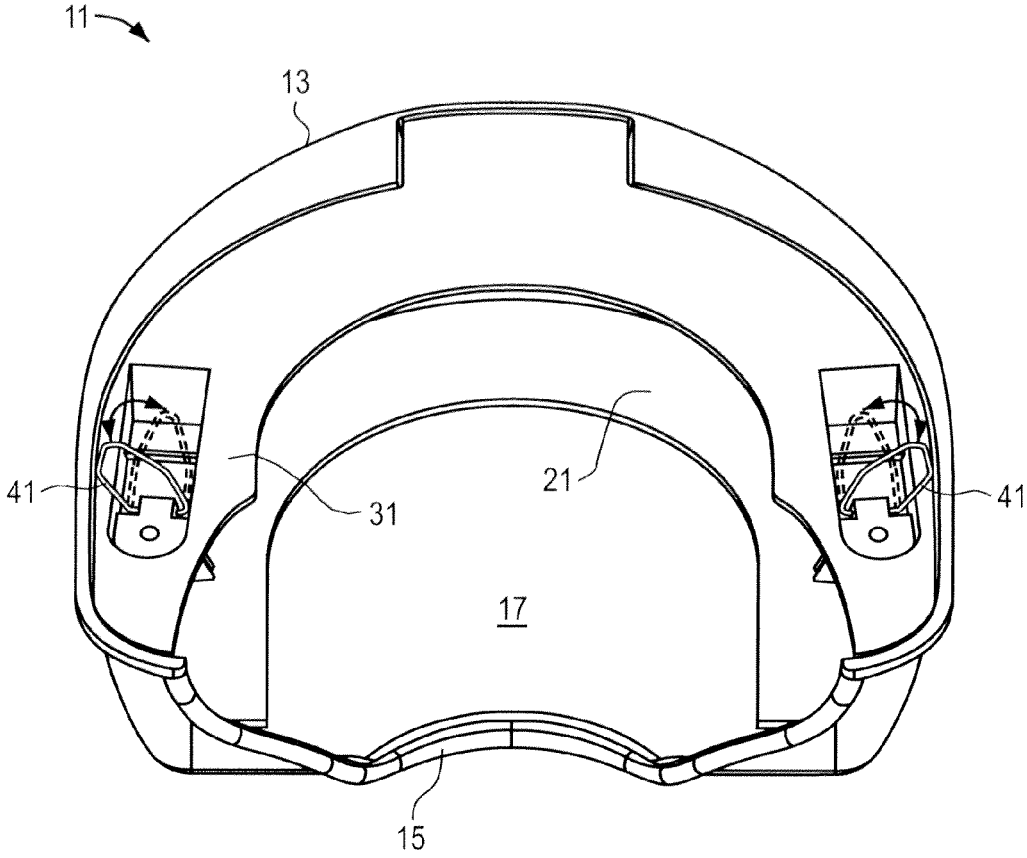
FIG. 5 is a bottom perspective view of the invented nail gel curing apparatus showing optional extension legs.

FIG. 5 shows the body 11 with optional legs 41 shown extended in solid line and in a closed position in dotted lines. In this connection when the apparatus is used to cure gel on the toe nails, it is sometimes necessary to raise the front of the opening 17 slightly so that the foot can be properly placed within opening 17 so that the LEDs 23 and 25 are properly positioned over the toe nails. When the apparatus is used for the feet, LEDs 37*a* and 37*b* are not in use, although typically power would still be applied. Of course, a switch or other mechanism could be used to so that power is not supplied to LEDs 37*a* and 37*b* when the device is used to cure gel on toe nails. For example, when the legs are in an extended position, a switch could be configured to turn off power to LEDs 37*a* and 37*b*.

Suitable LEDs for this purpose are available from Helio Optoelectronics Corp. using its part number HMHP-EILU. Each LED should have an emission spectrum so that most of its power distribution has a wavelength between approximately 380 and 425 nm at a wavelength of approximately 400 nm. This device has a forward voltage ranging between approximately 3.0 and 3.4 volts with a forward current in this voltage range between approximately 100 and 500 mA. LEDs with these characteristics should be located so that when the hand of a person is properly inserted into the unit, the LED which is closest to the fingernail or thumbnail is approximately one-half to three quarters of an inch away. Depending upon the power of the LED utilized, and the type of gel utilized, the number of LEDs, spacing, and distances from the fingernails and thumbnails may vary. However, such variations are well within the understanding of persons having ordinary skill in the field of the invention.

Further, an appropriate power supply, on-off switches, and the like are not important for a proper understanding of the invention and, therefore are not described herein. However, the specifics of these items are well within the abilities of persons having ordinary skill in the field of the invention, as described herein and defined in the following claims.

The invention claimed is:

1. An apparatus to provide ultra-violet (UV) irradiation to cure a gel nail comprising:

a) a top section;

b) a bottom section, said top and bottom sections forming a unit with an opening sized to allow at least a portion of a human hand to be inserted;

d) an array of light emitting diodes (LEDs) disposed in said unit to emit UV irradiation in a first direction when supplied with electrical power;

e) at least one LED disposed in said unit to emit UV irradiation in a second direction when supplied with electrical power, wherein said first direction is approximately perpendicular to the second direction such that fingernails and a thumbnail of a human hand inserted into said opening substantially simultaneously receive amounts of UV irradiation sufficient to cure a UV curable gel applied to said fingernails and said thumbnail at approximately the same time, wherein said at least one LED is coupled to a board disposed in said bottom section.

2. The apparatus defined by claim 1 wherein said array of LEDs are coupled to a board disposed in said top section.

3. The apparatus defined by claim 2 further comprising a second board coupled to said base, said second board having at least one LED coupled thereto which is disposed to emit irradiation in a direction perpendicular to said first direction.

4. The apparatus defined by claim 1 wherein said array of LEDs are arranged on a board disposed in said top section.

5. The apparatus defined by claim 1 wherein said array LEDs and said at least one LED are electrically connected to each other.

6. The apparatus defined by claim 1 wherein said top section includes a plurality of fins on an outer surface thereof to provide increased surface area for improved heat dissipation.

7. The apparatus defined by claim 1 wherein said bottom section includes a pair of legs extending from a bottom portion thereof so as to raise said opening relative to a height of said opening when said legs are in a folded position.

8. An apparatus to provide ultra-violet (UV) irradiation to cure a gel nail comprising:

a) a top section;

b) a bottom section, said top and bottom sections forming a unit with an opening sized to allow at least a portion of a human hand to be inserted;

d) an array of LEDs arranged on a board disposed in said top section to emit UV irradiation in a first direction when supplied with electrical power;

e) at least one LED arranged on a second board coupled to a base disposed in said bottom section to emit UV irradiation in a second direction when supplied with electrical power, f) at least one LED arranged on a third board coupled to said base to emit UV irradiation in a third direction when supplied with electrical power, wherein said first direction is approximately perpendicular to the second direction and the third direction such that fingernails and a thumbnail of a left or right human hand inserted into said opening simultaneously receive amounts of UV irradiation sufficient to cure a UV curable gel applied to said fingernails and said thumbnail at approximately the same time.

9. The apparatus defined by claim 8 wherein said array of LEDs and said at least one LED on said second board and said at least one LED on said third board are electrically connected to each other.

10. An apparatus to provide ultra-violet (UV) irradiation to cure a gel nail comprising:

a) a top section;

b) a bottom section, said top and bottom sections forming a unit with an opening sized to allow at least a portion of a human hand to be inserted;

d) an array of light emitting diodes (LEDs) disposed in said unit to emit UV irradiation in a first direction when supplied with electrical power;

e) at least one LED disposed in said unit to emit UV irradiation in a second direction when supplied with electrical power, wherein said first direction is approximately perpendicular to the second direction such that fingernails and a thumbnail of a human hand inserted into said opening substantially simultaneously receive amounts of UV irradiation sufficient to cure a UV curable gel applied to said fingernails and said thumbnail at approximately the same time; and further comprising:

f) a base with said at least one LED disposed in said bottom section.

11. The apparatus defined by claim 10 wherein said array of LEDs are coupled to a board disposed in said top section.

12. The apparatus defined by claim 10 further comprising a board coupled to said base wherein said at least one LED is coupled to said board.

13. The apparatus defined by claim 12 further comprising a second board coupled to said base, said second board having at least one LED coupled thereto which is disposed to emit irradiation in a direction perpendicular to said first direction.

14. The apparatus defined by claim 10 wherein said array of LEDs are arranged on a board disposed in said top section.

15. The apparatus defined by claim 10 wherein said array of LEDs and said at least one LED are electrically connected to each other.

16. The apparatus defined by claim 10 wherein said top section includes a plurality of fins on an outer surface thereof to provide increased surface area for improved heat dissipation.

17. The apparatus defined by claim 10 wherein said bottom section includes a pair of legs extending from a bottom portion thereof so as to raise said opening relative to a height of said opening when said legs are in a folded position.

* * * * *